US005199696A

United States Patent [19]

Kato

[11] Patent Number: 5,199,696

[45] Date of Patent: Apr. 6, 1993

[54] PAPER FEEDING UNIT

[75] Inventor: Shogo Kato, Hino, Japan

[73] Assignee: Konica Corporation, Tokyo, Japan

[21] Appl. No.: 921,428

[22] Filed: Jul. 31, 1992

Related U.S. Application Data

[63] Continuation of Ser. No. 716,101, Jun. 17, 1991, abandoned.

[30] Foreign Application Priority Data

Jun. 19, 1990 [JP] Japan ..... 2-162331
Jun. 20, 1990 [JP] Japan ..... 2-162451

[51] Int. Cl.[5] ..... B65H 5/00

[52] U.S. Cl. ..... 271/10; 271/114; 271/118; 271/122

[58] Field of Search ..... 271/114, 116, 118, 117, 271/122, 10

[56] References Cited

U.S. PATENT DOCUMENTS

| | | | |
|---|---|---|---|
| 3,815,900 | 6/1974 | Schulze | 271/118 |
| 3,961,786 | 6/1976 | Yanker | 271/10 X |
| 4,556,209 | 12/1985 | Tsubo | 271/118 X |
| 4,801,134 | 1/1989 | Yokoyama et al. | 271/122 |
| 4,900,003 | 2/1990 | Hashimoto | 271/118 X |
| 4,925,062 | 5/1990 | Tsukamoto et al. | 271/118 X |
| 5,039,080 | 8/1991 | Kato et al. | 271/122 |

*Primary Examiner*—David H. Bollinger
*Attorney, Agent, or Firm*—Finnegan, Henderson, Farabow, Garrett & Dunner

[57] ABSTRACT

A paper feeding unit for feeding paper sheet by sheet from a stack of paper in a paper feeding cassette is disclosed here. The paper feeding unit is provided with a pick up roller for pulling out a sheet of paper from the top surface of the stack, a swing lever for intermittently making the pick-up roller come in contact with the top surface, a cam for swinging the swing lever and a clutch for intermittently driving the pick-up roller to rotate a predetermined angle of rotation.

6 Claims, 10 Drawing Sheets

PAPER FEEDING UNIT

This application is a continuation of application Ser. No. 07/716,101, filed Jun. 17, 1991, now abandoned.

BACKGROUND OF THE INVENTION

The present invention relates to a paper feeding unit provided in an image recording apparatus such as a copier, facsimile or printer, and more particularly relates to improvements in a paper feeding unit which feeds papers sheet by sheet from a paper feeding cassette or a hand feeding tray in which a plurality of papers can be held.

A paper feeding unit which feeds a sheet-shaped paper (such as a recording paper, a document paper or the like) sheet by sheet from the top of a stack of papers placed on a paper tray, paper feeding cassette or paper stacker, has been conventionally provided in an image recording apparatus such as a copier or printer. A corner separating system in which a separating claw is used and a frictional separating system in which a roller and belt are used, are commonly put into practical use for an upper paper feeding cassette.

A paper feeding unit provided with a corner separator (a separating claw), a bottom plate pushing member oscillated by a cam, a movable bottom plate, and a paper feeding roller, has been disclosed in the official gazette of Japanese Patent Application Open to Public Inspection No. 135034/1980.

A paper feeding unit provided with a corner separator, a coil spring, and a paper feeding roller, has been disclosed in the official gazette of Japanese Patent Application Open to Public Inspection No. 46255/1981.

A paper feeding unit of a frictional separation system has Application Open to Public Inspection No. 127935/1988 and No. 123772/1989, and in the official gazettes of Japanese Utility Model Open to Public Inspection No. 96441/1989 and 121036/1989. In this system, a separation claw and coil spring are not provided inside the paper feeding cassette, so that recording papers can be easily loaded and exchanged as compared with the corner separating system.

A pick-up roller which comes into contact with stacked papers, and a feed roller and reverse roller to prevent double feeding are provided in the position close to the leading edges of the papers placed in a paper feeding cassette in the paper feeding unit of a frictional separation system.

In the paper feeding process of this paper feeding unit, a paper is fed as follows. First of all, the upper surface of the paper is raised up to the set position, and the rotation of a pick-up roller and feed roller is started in accordance with a paper feeding signal. The pick-up roller which comes into contact with the upper surface of the paper with pressure, conveys the paper to a nip position between the feed roller and reverse roller. The reverse roller is driven in the direction reverse to the paper advance, and contacted with the feed roller with pressure by a spring force.

When the reverse roller is directly contacted with the feed roller (in other words, when there is no paper in the nip position), or when a sheet of paper is fed into the nip position, the torque given to the reverse roller exceeds the limit value so that the reverse roller slips and rotates together with the feed roller. However, when not less than 2 sheets of papers are fed into the nip position, the limit torque becomes stronger than the frictional force between the papers so that the reverse roller rotates in the opposite direction. Accordingly, the lower side paper in the nip position is pushed back so that double feeding (which is to feed a plurality of papers simultaneously) can be prevented. In the manner described above, papers are separated sheet by sheet and conveyed to a register roller.

Conventionally, there are two types of paper cassette loading system, one is a side loading type and the other is a front loading type.

In the side loading type, a cassette insert opening is formed on one side of the recording apparatus body, and a paper feeding cassette is set to the opening laterally. The papers in the paper feeding cassette are conveyed by a paper feeding unit in the same direction as the paper feeding cassette inserting direction.

As described above, in the aforementioned side loading type, the paper cassette inserting direction is the same as the recording paper feeding direction, so that the relation between the paper feeding unit and the leading edge position of the recording papers is determined when the paper feeding cassette is set to the cassette insertion opening. Accordingly, this type of paper feeding cassette loading system is advantageous in that: a recording paper is easily conveyed; and when there is a jam in recording paper conveyance, the jammed paper can be easily removed from the apparatus by pulling out the paper feeding cassette.

On the other hand, this type of paper feeding cassette loading system has the following shortcomings: a space must be made on a side of the recording apparatus in order to detach the paper feeding cassette from the apparatus so that a wide space of installation is needed; and the maneuverability of the apparatus is not so good since the paper feeding cassette is handled on the side of the recording apparatus.

The front loading type of paper feeding cassette loading system is composed in such a manner that: a cassette feed opening or a cassette stacker is provided on the working side of the image recording apparatus and the paper feeding cassette is inserted into the apparatus from the working side; and a recording paper is fed in the direction perpendicular to the paper feeding cassette insert direction (which has been disclosed in the official gazettes of Japanese Patent Application Open to Public Inspection Nos. 45466/1984 and 50062/1987).

According to the structure described above, the paper feeding cassette can be detached on the working side of the apparatus, so that the following advantages can be provided: the maneuverability is high; and the space of installation is small since there is no need to leave a space on the side of the apparatus.

In the aforementioned conventional frictional separation type of paper feeding mechanism, after the first paper has been conveyed by the feed and reverse rollers, the leading edge of the second paper is pushed back by the reverse roller and stays in the position close to the nip position of the above-described two rollers coming into contact with the circumferential surface of the reverse roller.

If the paper feeding cassette is pulled out under the condition described above, the uppermost paper remains in the recording paper feeding unit. When an operator attaches the recording paper feeding cassette, and he is not aware of the residual paper, and a paper jam will occur causing the sensor and roller to damage.

Further, the following problem occurs. When the uppermost paper of the paper feeding cassette is located in the position close to the reverse roller and another paper is fed by a hand feeding unit, the paper is overlapped onto the previous paper so that a paper jam occurs.

In the case of the front loading type of paper feeding unit, the recording paper is conveyed in the direction perpendicular to the paper feeding cassette inserting direction. Accordingly, when the recording operation is stopped, several uppermost recording papers housed in the paper feeding cassette are pushed out in the paper feeding direction by the aforementioned pick-up roller, so that the leading edges of the pushed-out recording papers are located in the position closed to the nip position between the feed and reverse rollers. If the paper feeding cassette is pulled out under the condition described above, the recording papers are pulled out in the direction perpendicular to the paper feeding direction while the leading edges of the several uppermost papers are protruded into the position close to the nip position and the stack of papers in the paper feeding cassette are pressed by the pick-up roller. Consequently, the leading edge portions of the several uppermost recording papers remain inside the recording apparatus and the middle portions of the papers are pulled out from the apparatus, so that the recording papers are stretched and torn.

SUMMARY OF THE INVENTION

It is a primary object of the present invention to solve the aforementioned problems and to provide a paper feeding unit characterized in that: the structure is simple and operation can be positively conducted, so that damage of the unit can be prevented and careless mistakes can be eliminated, and further a normal operation can be easily realized.

The above described object can be accomplished by a paper feeding unit in which is provided a conveyance means composed of a drive rotating member coming into contact with the uppermost paper so as to convey the uppermost paper of a paper stack housed in a paper feeding cassette, and which comprises: a cam means by which the aforementioned drive rotating member is contacted with and separated from the aforementioned uppermost paper by the action of an oscillating member; and a clutch means by which the aforementioned drive rotating member is stopped after it has been rotated by a predetermined number of revolutions.

The paper feeding unit of the present invention is characterized in that: a cam member of the above-described cam means and a one-revolution-stop-clutch of the above-described clutch means are provided on the same shaft as the intermediate shaft which is located in the drive system between a drive source and the above-described rotating member.

Furthermore, the paper feeding unit of the present invention is characterized in that: a reduction gear means is connected with the above-described one-revolution-stop-clutch and the above-described rotating member is rotated by a predetermined angle when the one-revolution-stop-clutch has been rotated by one revolution so that a conveyed sheet can reach the nip position of conveyance rollers installed downstream.

The working action conducted when a recording paper is conveyed from the paper feeding cassette in the paper feeding unit of the present invention, will be explained as follows.

The paper feeding cassette is loaded to the paper feeding section of the recording apparatus body and a copy button is pressed.

(1) A motor starts to rotate.

(2) A solenoid is turned, and an engaging claw which checks a ratchet wheel of the one-revolution-clutch is withdrawn so that the ratchet wheel can be rotated. Accordingly, the one-revolution clutch is connected, and a pick-up roller and feed roller start to rotate.

(3) A cam section provided on an intermediate shaft is rotated by a drive transmission system, and the first arm which slidably comes into contact with the cam section is oscillated around a supporting shaft. Then, the pick-up roller goes downward by its own weight and comes into contact with the surface of the uppermost paper housed in a paper feeding cassette.

(4) When the pick-up roller rotates and comes into contact with the surface of the paper with pressure, the recording papers placed on the upper portion of a stack on a paper feeding cassette are conveyed. The uppermost paper is separated from others when the paper passes through the feed roller, and is conveyed by a predetermined distance.

(5) When a cam member is rotated by one revolution, the second arm which is combined into one unit together with the first arm, is oscillated, and the pick-up roller is raised so that it can be separated from the upper surface of the stack of recording papers.

(6) Almost simultaneously with the motion described above, the one-revolution-clutch is rotated by one revolution so that the ratchet wheel engages with a claw provided on the top of the solenoid, and the connection of the clutch is released.

(7) When the connection of the clutch has been released, the connection of the drive force transmitting system is disconnected, so that the rotation of the intermediate shaft having the cam member and the one-revolution-clutch, and that of a feed roller shaft are stopped. Consequently, the pick-up roller and feed roller are stopped.

(8) In order to make the leading edge of a recording paper reach the nip position of the intermediate conveyance roller while the one-revolution clutch rotates by one revolution, the conveyance distance can be optionally adjusted by changing the gear ratio of a gear device connecting the intermediate shaft with a pick-up shaft.

The above-described object can be accomplished by a paper feeding unit in which a paper feeding means to feed the uppermost paper of a stack housed in a paper housing section is provided, and in which a double feeding prevention means composed of a feed roller and a reverse roller coming into contact with the feed roller with pressure is provided on the downstream side of the aforementioned paper feeding means, and which comprises: an oscillating means which oscillates the aforementioned feeding means so that the feeding means can be contacted with and separated from the uppermost surface of the stacked papers placed in a paper housing section; and a normal and reverse rotation regulating section which is composed in such a manner that the angle of play is provided in the connecting portion between the aforementioned feed roller and a one-way-clutch which regulates the rotation of the feed roller, wherein after the aforementioned double feeding prevention means has conveyed one sheet of paper, the aforementioned paper feeding means is oscillated upward and withdrawn so that the pressure contact with the paper surface can be released, and the aforementioned feed roller is reversely rotated by the aforementioned angle of play by the action of the reversely rotating force of the aforementioned reverse roller in order to push back the second paper.

Further, the paper feeding unit of the present invention is characterized in that: a torque limiter is connected with the aforementioned reverse roller so that the aforementioned feed roller coming into pressure contact with the reverse roller can be reversed by the aforementioned play angle by the reversely rotating force of the torque limiter.

The working action conducted when a recording paper is conveyed from the paper feeding cassette in the paper feeding unit of the present invention, will be explained as follows.

The paper feeding cassette is loaded to the paper feeding section of the recording apparatus body and a copy button is pressed.

(1) A motor starts to rotate, and the drive system transmits rotation.

(2) A solenoid is turned, and an engaging claw which checks a ratchet wheel of the one-revolution-clutch is withdrawn so that the ratchet wheel can be rotated. Accordingly, the one-revolution clutch is connected, and a pick-up roller and feed roller start to rotate.

(3) A cam section provided on an intermediate shaft is rotated by a drive transmission system, and the first arm which slidably comes into contact with the cam section is oscillated around a supporting shaft. Then, the pick-up roller goes downward by its own weight and comes into contact with the surface of the uppermost paper housed in a paper feeding cassette.

(4) When the pick-up roller rotates and comes into contact with the surface of the paper with pressure, the recording papers placed on the upper portion of a stack on a paper feeding cassette are conveyed. The uppermost paper is separated from others when the paper passes through the feed roller, and is conveyed by a predetermined distance.

(5) When a cam member is rotated by one revolution, the other arm which is combined into one unit together with the aforementioned arm, is oscillated, and the pick-up roller is raised so that it can be separated from the upper surface of the stack of recording papers.

(6) While the one-revolution-clutch is rotated by one revolution, the leading edge of the recording paper reaches the nip position of the intermediate conveyance roller.

(7) After the trailing end of the recording paper has passed through the nip position between the feed roller and the reverse roller, the reverse roller is reversely rotated a little by the reversely rotating force of the torque limiter connected with the reverse roller, and at the same time, the feed roller which comes into pressure contact with the reverse roller, is also reversely rotated by the aforementioned play angle provided to the connecting portion. Since the feed roller is reversely rotated in the manner described above, the second paper and the papers after the second paper are pushed back so that they are put in a stand-by condition.

(8) When the one-revolution-clutch has been rotated by one revolution, an engaging claw engages with the tooth portion of the ratchet wheel so that the connection of the clutch is released.

When the clutch connection has been released in the manner described above, the drive force transmitting system is disconnected, so that the cam section, the intermediate shaft having the one-revolution-clutch, and the feed roller shaft are all stopped. Consequently, the pick-up roller and feed roller are stopped.

DETAILED DESCRIPTION OF THE PREFERRED EMBODIMENTS

Referring now to the attached drawings, an embodiment of the present invention will be explained as follows.

Figure 1:
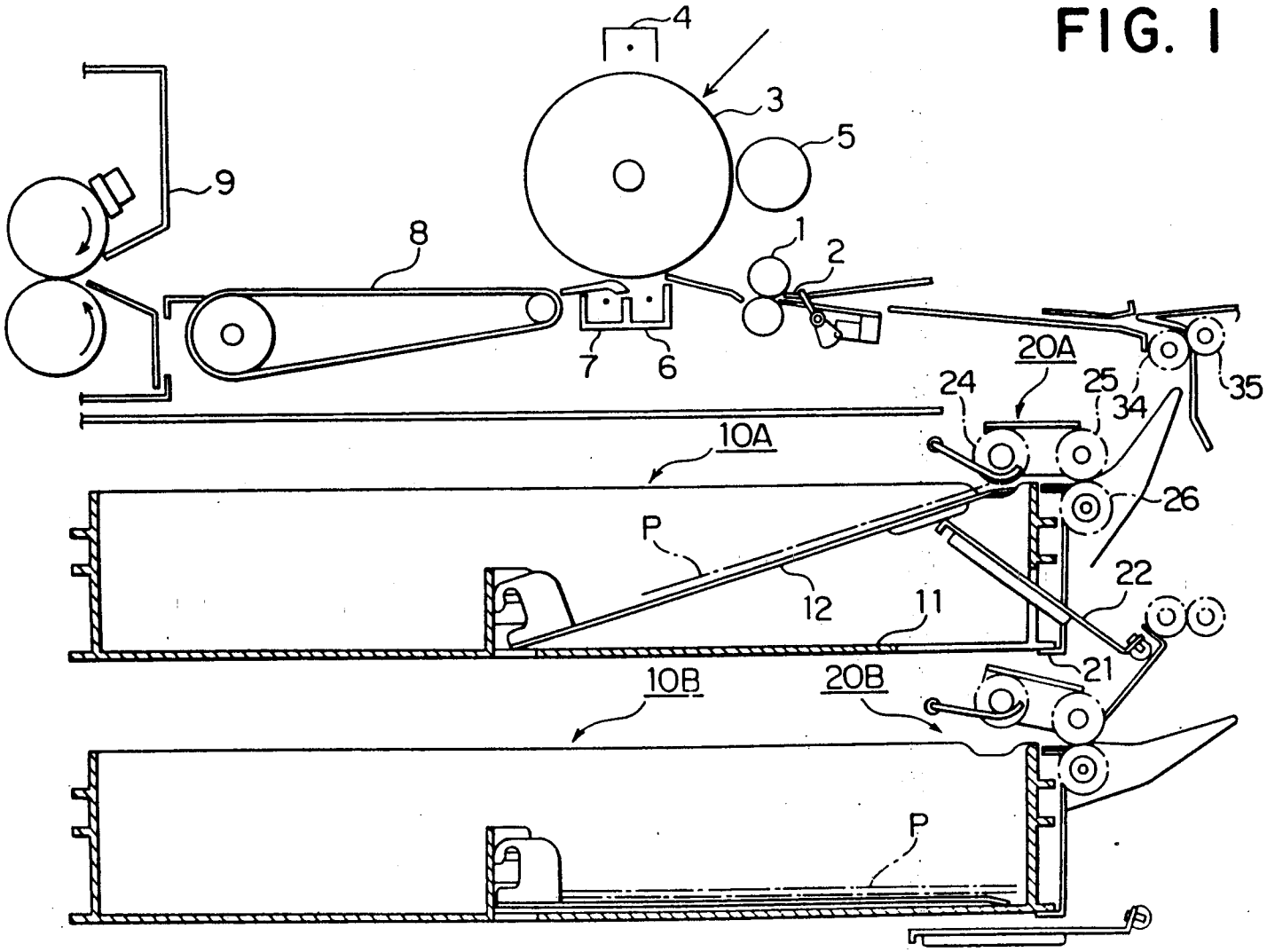
FIG. 1 is a sectional view of a paper feeding unit showing a state of paper feeding, wherein a paper feeding cassette is set to the paper feeding section of a recording apparatus body.

FIG. 1 is a sectional view of the substantial portion of an image recording apparatus, to the two-deck paper feeding unit of which paper feeding cassettes 10A, 10B are provided. The drawing shows the following states: the upper paper feeding section is in the state of paper feeding; and the lower paper feeding section is in the state in which paper feeding is not conducted.

Figure 2:
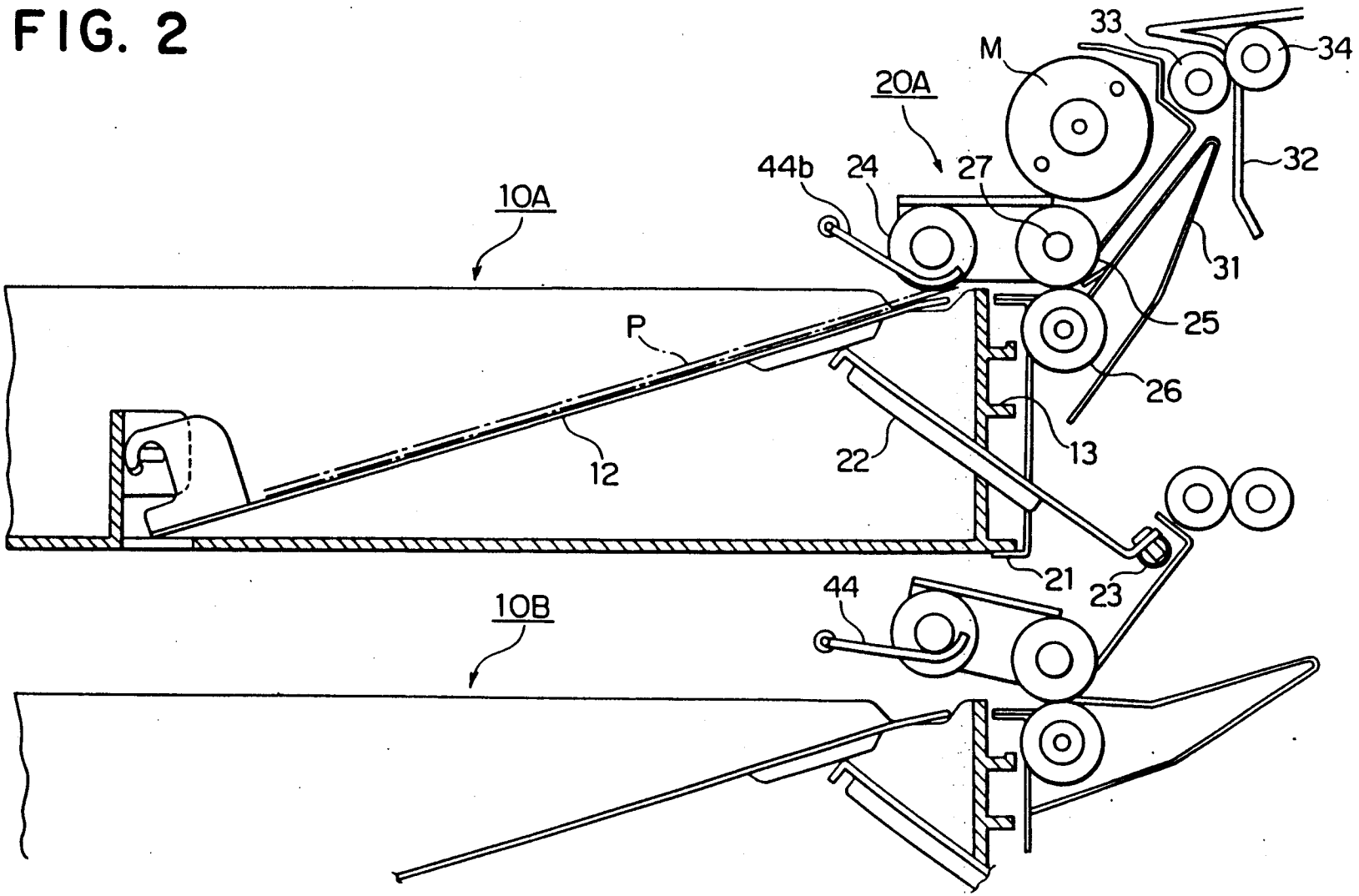
FIG. 2 is a sectional view of the substantial portion of the paper feeding unit of the present invention.

FIG. 2 is a partially enlarged sectional view of the two-deck paper feeding unit.

In this embodiment, the present invention is applied to a paper feeding unit characterized in that: a recording paper (a transfer paper) in a recording paper stack housed in the paper feeding cassettes 10A, 10B which are detachably provided to the lower portion of an image forming apparatus, is sent out and conveyed to the circumferential surface of an image forming body through an intermediate conveyance roller. However, the present invention can be applied not only to the aforementioned paper feeding unit but also to the following paper units: a paper feeding unit in which a large number of recording papers (for example, 1000 sheets of papers) can be housed; a paper feeding section of an automatic two-sided copier which is installed in the lower portion of an image recording apparatus; and a paper feeding section of an automatic document conveyance unit which is installed in the upper portion of an image recording apparatus.

First of all, the structure of the paper feeding cassettes 10A, 10B will be explained as follows. In this case, the structure of the upper paper feeding cassette 10A and that of the lower paper feeding cassette 10B are approximately the same, so that the upper paper feeding cassette 10A and the paper feeding section 20A will be mainly explained.

Recording paper P which has been stacked on a movable bottom plate 12 of either paper feeding cassette (for example, the paper feeding cassette 10A), is conveyed in such a manner that: recording paper P is sent out from the paper feeding cassette 10A when the movable bottom plate 12 is raised by a push-up lever 22 operated by a paper feeding signal, and when a pick-up roller 24 is lowered and rotated coming into contact with recording paper P; recording paper P is successively sent into the nip position between a feed roller 25 and a reverse roller 26; recording paper P is conveyed by intermediate rollers 34, 35; and when the leading edge of recording paper P is detected by a sensor 2 located just before a register roller 1, advance of recording paper P is stopped being controlled by a CPU. At this moment, the surface of an image forming body (a photoreceptor drum) 3 is charged by a charger 4 and a document image exposure is conducted by optical scanning system L. Then, the exposed document image is developed by a developing unit 5, and a toner image is formed.

Next, the aforementioned register roller 1 is rotated in time with the aforementioned image formation, and recording paper P is conveyed into a transfer region of a transfer unit 6, wherein the conveyance speed of recording paper P is adjusted to the circumferential speed of the photoreceptor drum 3. In the manner described above, the toner image formed on the photoreceptor drum 3 is transferred onto recording paper P.

Recording paper P onto which the aforementioned toner image has been transferred, is separated from the circumferential surface of the photoreceptor drum 3 by a separator 7, conveyed by a conveyance belt 8, and placed on a delivery paper tray through a paper delivery roller not illustrated in the drawing.

The paper feeding cassettes 10A, 10B in which different sizes or different kinds of recording papers, or the same size or the same kind of recording papers are housed, are set to the upper paper feeding section 20A and the lower paper feeding section 20B in the image recording apparatus.

The paper feeding cassette 10A is composed of a cassette body 11 and the movable bottom plate 12. Recording paper P is placed on the upper surface of the movable bottom plate 12.

One end of the movable bottom plate 12 is rotatably engaged with a portion of the bottom of the cassette body 11, and the other end pushes the circumferential surface of a sending roller 24, which will be described later, through recording paper P when the movable bottom plate 12 has been raised. A cam face 13 is integrally formed on the outer side surface of the cassette body 11 on the downstream side of paper flow.

The paper feeding section 20A provided to the recording apparatus body comprises: a recording paper feeding stand 21 by which the recording paper feeding cassette 10A is fixed to a predetermined position; an ascent and descent drive section oscillated around an oscillating shaft 23 which connects a push-up lever 22 pushing up the aforementioned movable bottom plate 12, with a drive source; a paper feeding roller section including a sending-out roller (a pick-up roller) 24, a feed roller 25, a reverse roller 26, and an oscillating shaft (a feed roller shaft) 27; and a conveyance section including a movable guide plate 31, a fixed guide plate 32, an intermediate conveyance drive roller 33, and an idle roller 34.

Figure 3:
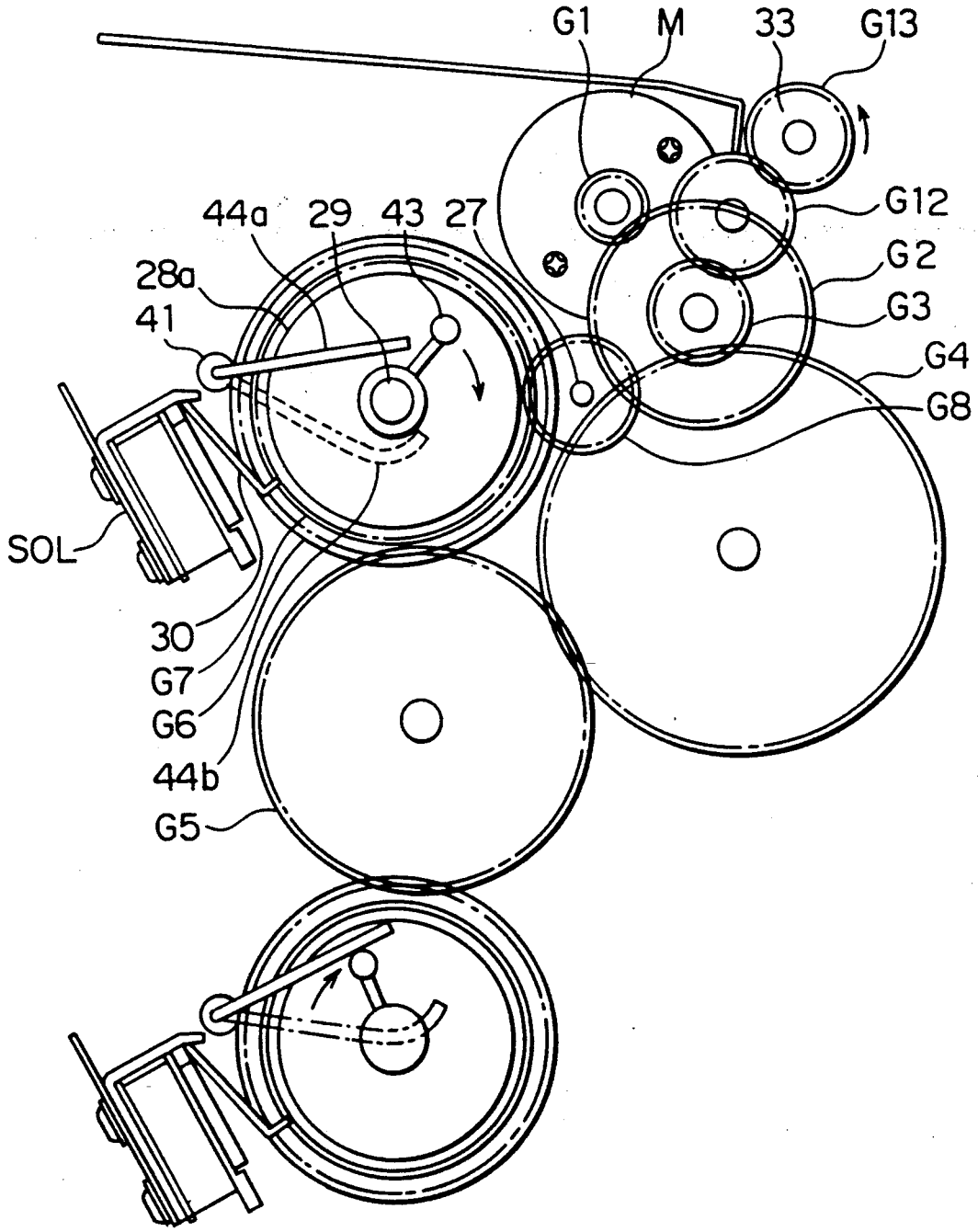
FIG. 3 is a front view of the drive system of the paper feeding unit.
Figure 4:
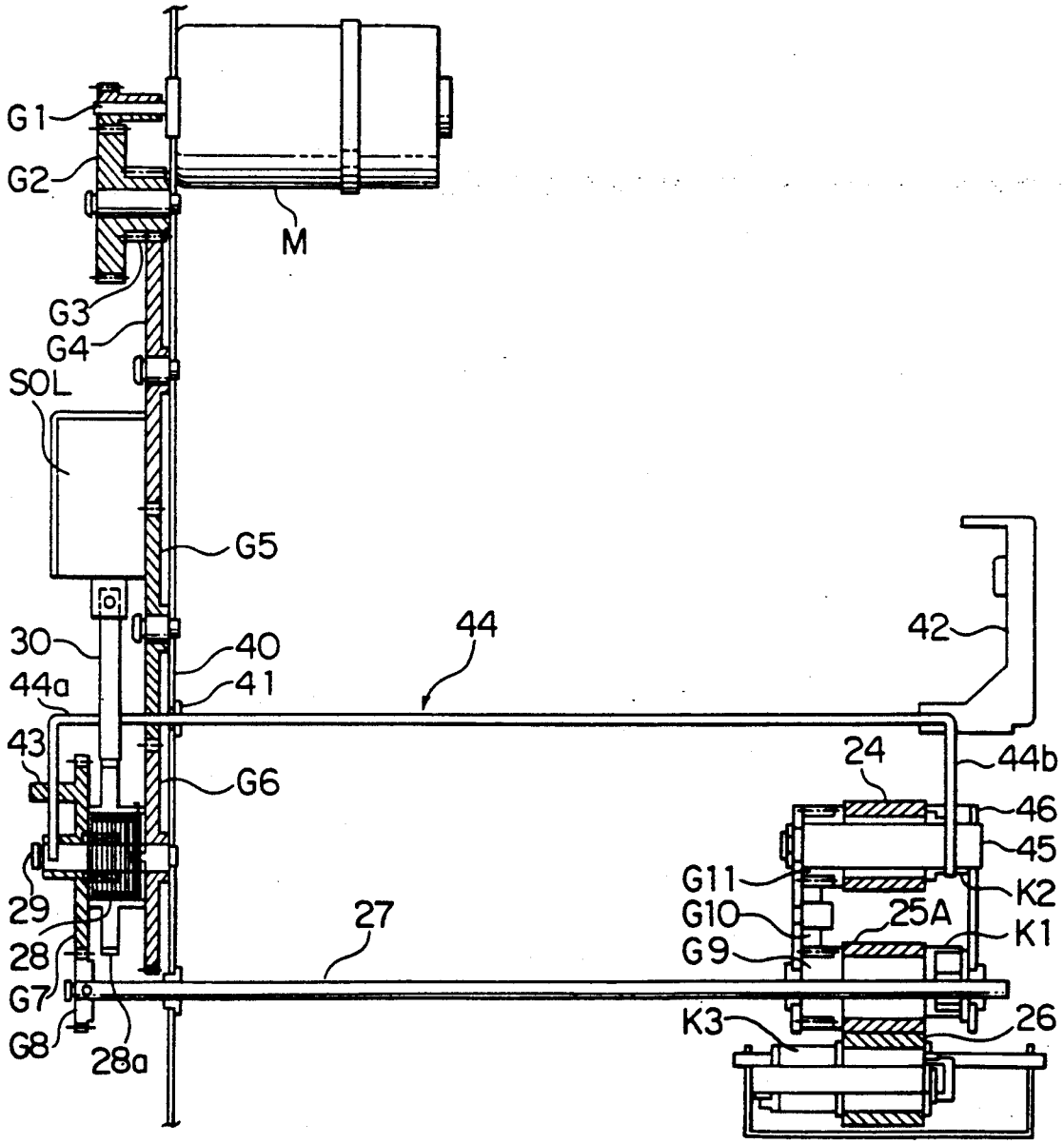
FIG. 4 is a developed plan view of the paper feeding unit.

FIG. 3 is a front view of the drive system of the paper feeding unit of the present invention. FIG. 4 is a developed plan view of the aforementioned paper feeding unit.

A drive system composed of motor M, a gear train, a clutch and the like is provided on the rear side of the aforementioned paper feeding stand 21. Gear G1 is fixed to the drive shaft of motor M. The aforementioned gear G1 rotates gear G8 mounted on the end of a roller shaft (an oscillating shaft) 27, through gears G2, G3, G4, G5, input gear G6 mounted on an intermediate shaft 29, and output gear G7.

The feed roller shaft 27 provided with gear G8 which meshes with gear G7, makes the feed roller 25 having one-way-clutch K1 rotate in one direction Gear G9 fixed to the feed roller shaft 27 meshes with gear G11 through idle gear G10, and makes the pick-up roller 24 having one-way clutch K2 rotate in one direction. Numeral 26 is a reverse roller which is provided with spring clutch K3, and which comes into pressure contact with the above-described feed roller 25.

On the other hand, the aforementioned gear G3 meshes with gear G13 through idle gear G12, and makes an intermediate roller shaft 33 having a one-way-clutch (not illustrated in the drawing) rotate in one direction. An intermediate conveyance roller 34 is integrally provided close to the middle portion of the aforementioned intermediate roller shaft 33, and comes into pressure contact with an idle roller 35 so that it can be rotated.

When the feed roller shaft 27 is driven by motor M, the feed roller 25 is rotated integrally with the feed roller shaft 27 by the action of the aforementioned one-way-clutch K1. When motor M is stopped, the feed roller 25 can be rotated by an external force in the aforementioned direction. However, the feed roller 25 can not be rotated in the reverse direction by the action of one way clutch K1. The pick-up roller 24 having one-way-clutch K2 is operated in the same manner as described above.

A spring clutch 28 is mounted on the aforementioned intermediate shaft 29 in such a manner that the spring clutch 28 is disposed between the aforementioned gears G6 and G7. A brake wheel member (for example a ratchet wheel) 28*a* is integrally provided around the circumference of the clutch 28. The ratchet wheel 28*a* engages with and is released from an engaging claw 30 of solenoid SOL.

The spring clutch 28 provided between the aforementioned ratchet wheel 28*a* and output gear G7 serves as follows: when the ratchet wheel 28*a* is engaged with the engaging claw 30 of solenoid SOL, output gear G7 slips with regard to gear G5 which is connected with drive gear G1 of motor M, so that the drive force is not transmitted to gear G8 and a feed roller shaft 27. When the ratchet wheel 28*a* is released from the engagement by solenoid SOL, the ratchet wheel 28*a* and output gear G7 are integrally rotated and the drive force of motor M is transmitted to gear G8 so that the feed roller shaft 27 is rotated. When the ratchet wheel 28*a* is rotated by one revolution, solenoid SOL is activated, and the engaging claw 30 meshes with the tooth portion of the ratchet wheel 28a so that the rotation of the ratchet wheel 28a is stopped.

When the spring clutch 28 and gear G7 are rotated by one revolution, gear G8 which meshes with gear G7 is rotated by a plurality of revolutions. The gear ratio of the gear train is set in such a manner that recording paper P is conveyed by the feed roller 25 so that it can reach the nip position of the intermediate conveyance roller 34.

An arm-shaped cam member 43 is integrally protruded from the surface of the aforementioned gear G7. On the other hand, an oscillating lever 44 is rotatably supported by a bearing 41 protruding from a side wall 40 of the paper feeding unit and supported by a support member 42 installed on the fixed wall of the paper feeding unit. One end portion 44a (which is curved so that it can serve as a cam follower) of the aforementioned oscillating member (which will be called an oscillating lever, hereinafter) slidably comes into contact with the aforementioned cam member 43 and follows the rotating motion of the cam member 43 so that the end portion 44a is oscillated. The other curved end portion 44b of the oscillating lever 44, engages with a frame 46 which holds a pick-up roller shaft 45, the pick-up roller 24 and the feed roller 25, and oscillates the pick-up roller 24 around a feed roller shaft 27.

Figure 5A:
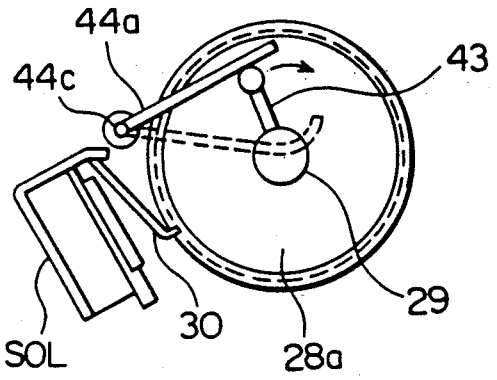
FIG. 5-A and FIG. 5-B are partial front views showing a condition of the above-described paper feeding unit by which a paper is not fed.
Figure 5B:
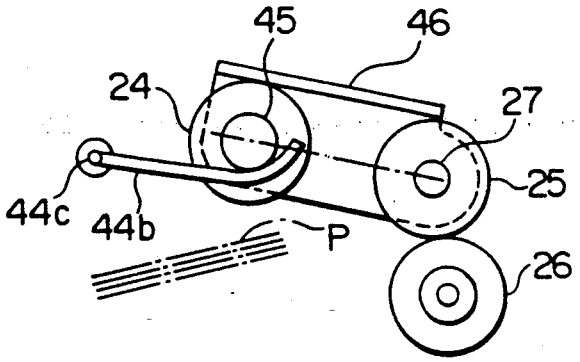

FIG. 5-B is a front view of a paper feeding section which is in a state in which a recording paper is not conveyed. FIG. 5-A is a partial front view of the engaging portion. When solenoid SOL is not energized, the engaging claw 30 meshes with the ratchet tooth portion of the ratchet wheel 28a so that the rotation of the ratchet wheel 28a is stopped, and the drive force of motor M is not transmitted to output gear G6. Under the condition described above, the cam member 43 raises one end portion 44a of the oscillating lever 44, and the other end portion 44b, which is made into one unit with the aforementioned end portion 44a, holds and raises the pick-up roller shaft 45 upward.

Figure 6A:
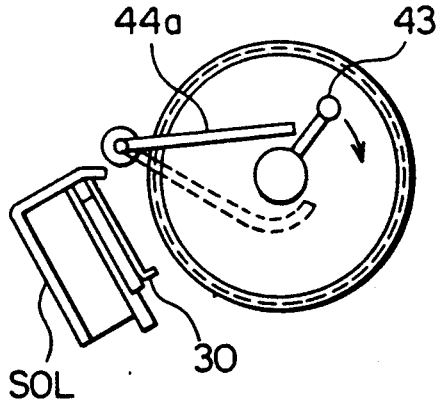
FIG. 6-A and FIG. 6-B are partial front views showing a condition of the above-described paper feeding unit by which a paper is fed.
Figure 6B:
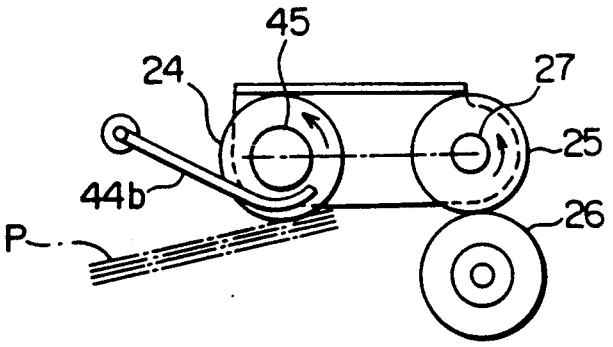

FIGS. 6-A and 6-B are front views of the paper feeding section which is in the state of paper feeding.

When solenoid SOL is temporarily energized, the engaging claw 30 is disengaged from the ratchet tooth portion of the ratchet wheel 28a. Accordingly, the drive force of motor M is transmitted by the spring clutch 28, and output gear G6 and the feed roller shaft 27 are rotated. When output gear G6 is rotated, the cam portion 43 is rotated clockwise, and the end portion 44a of the oscillating lever 44 rotates around the shaft 44c and descends from the upper position shown in FIG. 5-A to the lower position shown in FIG. 6-A. Consequently, as shown in FIG. 2 and FIG. 6 B, the other end portion 44b of the oscillating lever 44 also descends and stops at the lower position. The pick-up roller shaft 45 which has been held by the aforementioned end portion 44a, oscillates downward around the feed roller shaft 27 by its own weight. Accordingly, the circumferential surface of the pick up roller 24 comes into pressure contact with the uppermost surface of a stack of recording papers P which is placed on the movable pressure plate 12 housed in the paper feeding cassette 10A, wherein the stack of recording papers P are raised and held at a predetermined position.

Next, the operation of the paper feeding unit of the present invention will be explained as follows.

(1) First, the paper feeding cassette 10A is set to the paper feeding stand 21 of the paper feeding section 20A as shown by the upper paper feeding cassette in FIGS. 1 and 2. When the paper feeding cassette is set to the paper feeding section, the cam surface 13 on the side of the cassette body 11 rotates the oscillation shaft 23 clockwise through the drive force transmitting unit. The push-up lever 22 fixed to the oscillation shaft 23 also rotates clockwise and pushes up the movable bottom plate 12. When the uppermost surface of a stack of recording papers P which have been stacked on the upper surface of the aforementioned movable bottom plate, comes into contact with a detection member (not illustrated in the drawing), the rotation of the oscillation shaft 23 is stopped, and the motion of the push-up lever 22 is stopped under the condition that the push-up lever 22 holds the movable bottom plate 12. (Refer to the lower paper feeding cassette in FIG. 2.)

(2) After the paper feeding cassette is set to the paper feeding section, a copy button is pressed. Then, the drive shaft of motor M starts to rotate, and gear train G1–G6 of the drive force transmitting system transmits the drive force generated by motor M.

(3) When solenoid SOL is turned on, the engaging claw 30 is drawn by solenoid SOL, and the engagement of the ratchet wheel 28a provided on the outer circumferential surface of the spring clutch 28 is released so that the ratchet wheel 28 can be rotated. In the manner described above, the spring clutch 28 is connected, so that the rotating drive force of motor M is transmitted to gears G7 and G8, and the feed roller shaft 27 is rotated. Then, the feed roller 25 provided on the same shaft starts to rotate, and the pick-up roller 24 simultaneously starts to rotate by the action of gears G9–G11.

(4) The cam member 43 mounted on the intermediate shaft 29, on which the spring clutch 28 and gears G6, G7 are mounted, also starts to rotate since the drive force is transmitted through the aforementioned connection. Accordingly, the end portion 44a of the oscillating lever 44 which slidably comes into contact with the cam member 43, is oscillated around the shaft 44c and goes downward. The other end portion 44b which is combined with the aforementioned end portion 44a into one body, is also oscillated around the shaft 44c and withdraws downward. Consequently, the pick-up roller 24 descends by its own weight around the feed roller shaft 27, and comes into pressure contact with the uppermost surface of a stack of recording papers P which are placed on the movable bottom plate 12A in the paper feeding cassette 10.

(5) When the aforementioned pick-up roller 24 is driven and lowered so that the pick-up roller 24 can contact with the uppermost surface of the recording paper, the upper recording papers P housed in the paper cassette 10A are sent out from the cassette.

(6) The uppermost recording paper P is separated from other papers by the action of the feed roller 25 and reverse roller 26, and conveyed to the following process.

(7) While gears G6, G7, the spring clutch 28 and the cam member 43, which are mounted on the aforementioned intermediate shaft 29, rotate by one revolution, gear G8 which meshes with gear G7 rotates by a predetermined revolution, and the feed roller shaft 27, the feed roller 25 and the pick-up roller 24 also rotate by a predetermined revolution. When the feed roller 25 and the the pick-up roller 24 rotate in the manner described above, recording paper P which comes into pressure contact with the circumferential surfaces of those rollers is conveyed, and reaches the nip position between the intermediate conveyance roller 34 and the idle roller 35.

(8) When the rotation of the aforementioned spring clutch 28 almost comes to the end of one revolution, the cam member 43 which is combined with the spring clutch 28 into one unit, raises the end portion 44a of the oscillating lever 44. (Refer to FIG. 5-A.) Accordingly, the other end portion 44b raises and oscillates the pick-up roller shaft 45 around the feed roller shaft 27 clockwise. When the pick-up roller shaft 45 is raised, the pick-up roller 24 is separated from the upper surface of the recording paper.

(9) When the aforementioned spring clutch 28 rotates by one revolution, voltage is impressed upon solenoid SOL, and the engaging claw 30 meshes with the tooth portion of the ratchet wheel 28a so that the spring clutch stops to rotate and clutch connection is released.

(10) When the connection of the spring clutch is released, the drive force transmission system is disconnected and gear G7 stops rotating, so that gear G7, the cam portion 43 and the spring clutch 28 stop rotating. Accordingly, the feed roller 25 and the pick up roller 24 stop rotating. Before both the rollers stop rotating, the aforementioned intermediate conveyance roller 34 starts to convey the recording paper.

As explained above, when a recording paper is not fed, the pick up roller 24 is oscillated and raised so that it can be located in a position higher than the surface of the recording paper. Only when the recording paper is fed, is the pick-up roller 24 oscillated and lowered so that it can feed the recording paper. Consequently, even when the paper feeding cassette is pulled out from the apparatus in order to check a paper jam or to supply recording papers, the recording papers housed in the paper feeding cassette and the pick-up roller do not interfere with each other, so that the recording papers are not damaged.

Referring to the attached drawings, another embodiment of the present invention will be explained as follows.

Figure 7A:
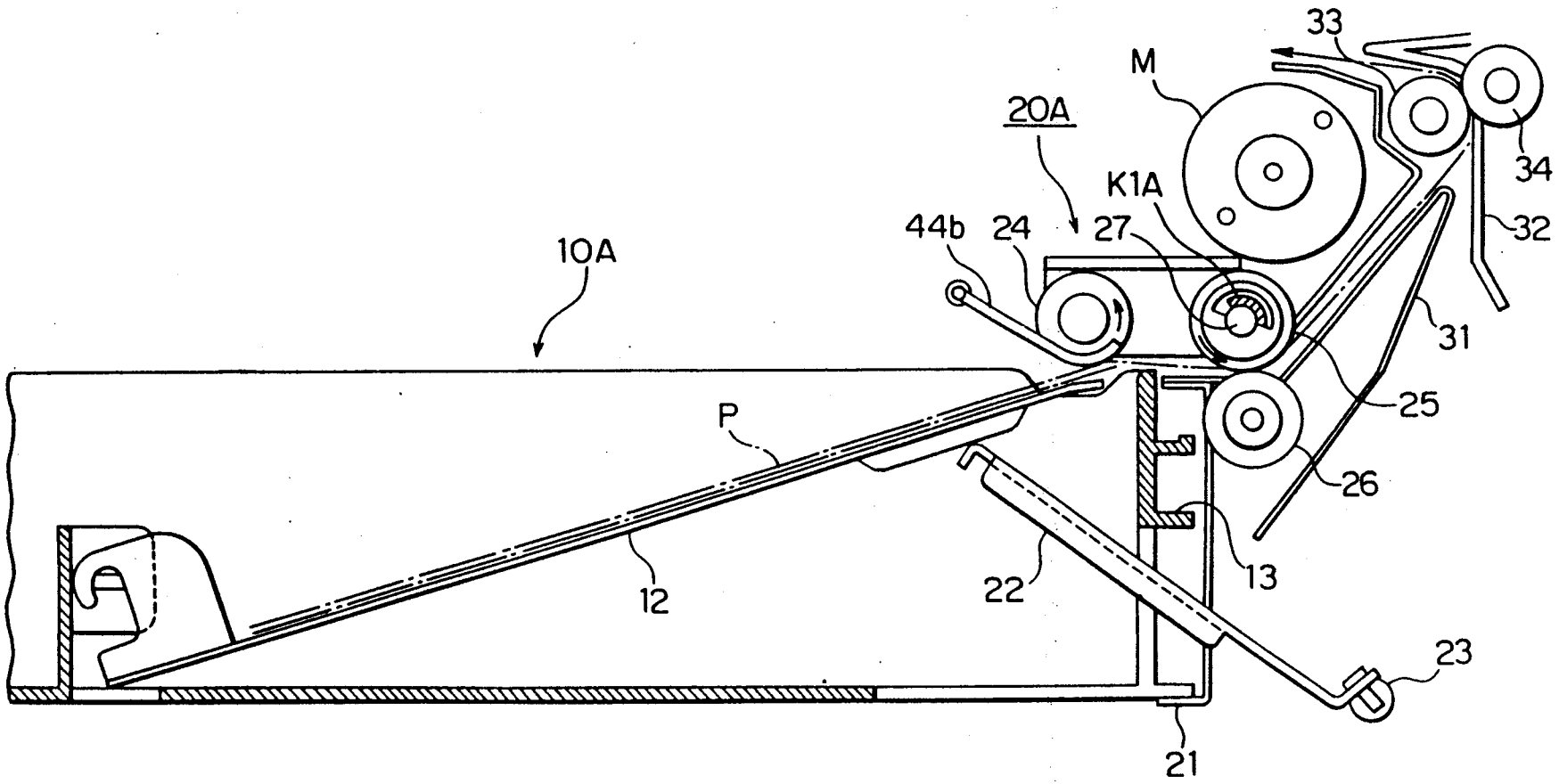
FIG. 7-A and FIG. 7-B are sectional views showing the substantial portion of the paper feeding unit of another embodiment of the present invention.
Figure 7B:
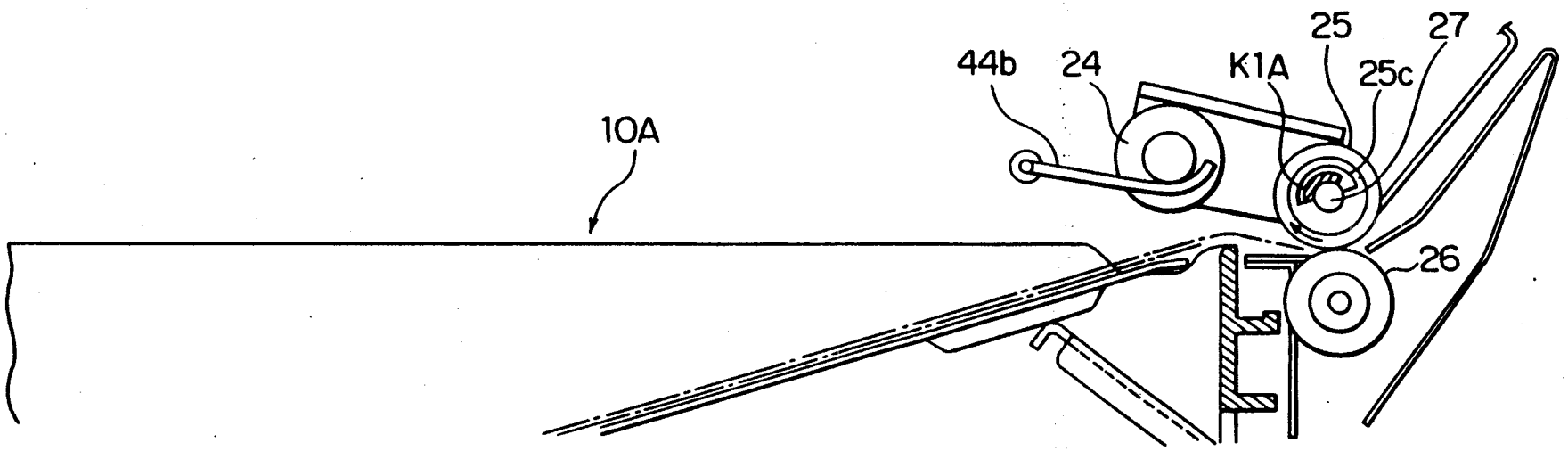

FIGS. 7-A and 7-B are partial sectional views of the paper feeding unit. Explanations common to the above-described embodiment will be omitted here.

The paper feeding section 20A of the apparatus body comprises: the paper feeding stand 21 which fixes the paper feeding cassette 10A to a predetermined position; the ascent and descent drive section which oscillates around the oscillating shaft 23 connecting the push-up lever 22 with the drive source; the paper feeding roller section which is composed of the pick-up roller 24, the feed roller 25, the reverse roller 26, and the oscillating shaft (the feed roller shaft) 27; and the conveyance section which is composed of the movable guide plate 31, the fixed guide plate 32, the intermediate conveyance drive roller 33 and the idle roller 34.

Figure 8:
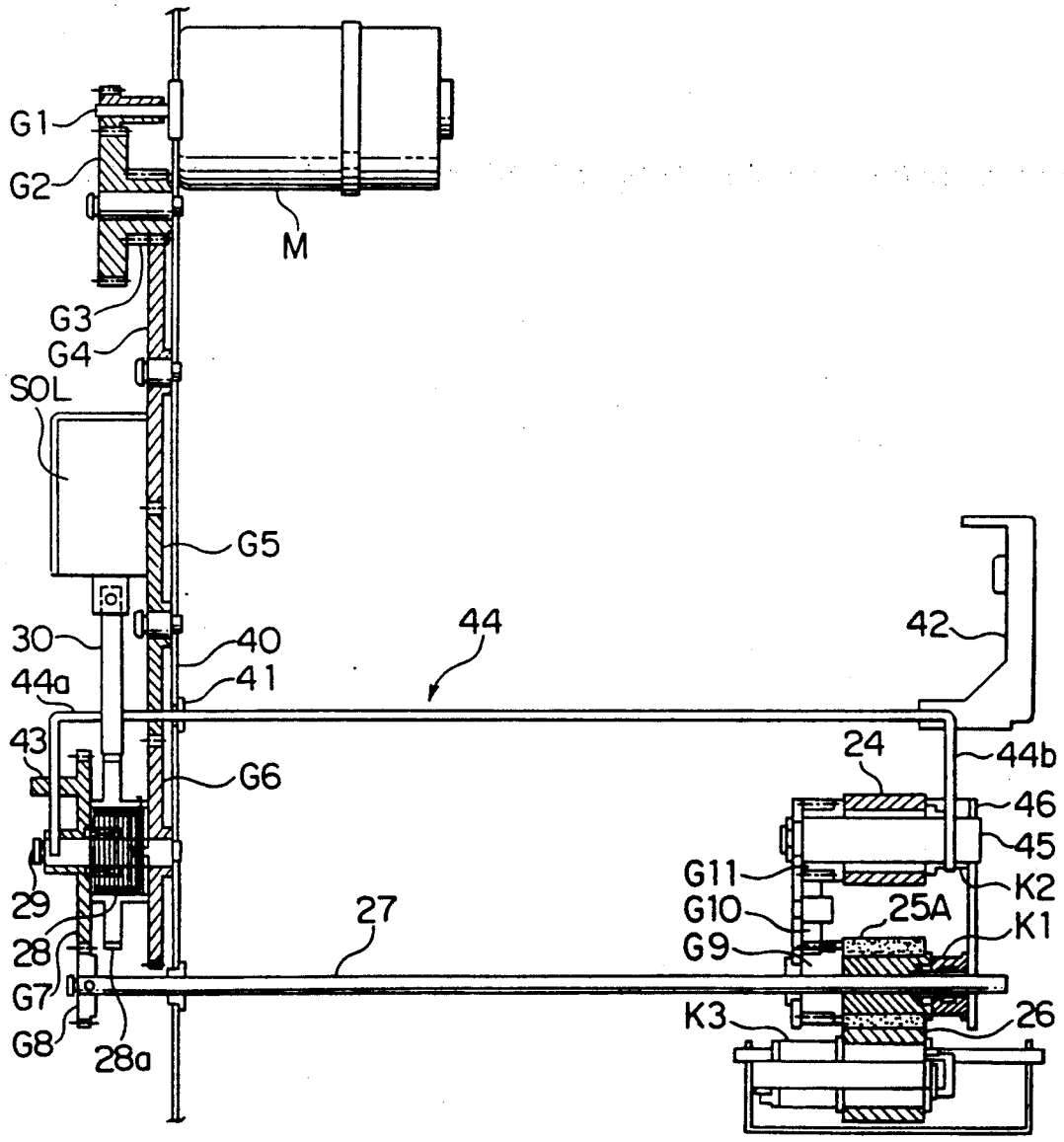
FIG. 8 is a front view of the drive system of the paper feeding unit.

FIG. 8 is an enlarged plan view of the paper feeding unit.

The drive system composed of motor M, a gear train and a clutch, is provided on the rear side of the aforementioned paper feeding stand 21. Gear G1 is fixed to the drive shaft of motor M. The aforementioned gear G1 rotates gear G8 mounted on the feed roller shaft (the oscillating shaft) 27 through gears G2, G3, G4, G5, G6 mounted on the intermediate shaft 29, and the output gear G7.

The aforementioned feed roller shaft 27 is provided with: the feed roller 25; the open type of spring clutch 28 (which stops when the clutch has been rotated by one revolution); and gear G 7. The feed roller shaft 27 on which gear G8 is mounted, wherein gear G8 meshes with gear G7, rotates the feed roller 25 having one-way-clutch K1 in one direction. Gear G9 fixed to the aforementioned feed roller shaft 27 meshes with gear G11 through the idle gear G10 and rotates the pick-up roller 24 having one-way-clutch K2 in one direction. Numeral 26 is a reverse roller which is contacted with the aforementioned feed roller 24 with pressure, wherein the reverse roller is provided with torque limiter K3. The aforementioned torque limiter is pushed by a spring in the direction reverse to the rotation of the reverse roller 26, which is the direction reverse to the advance of recording paper P).

The reverse roller 26 is driven in the direction reverse to the advance of a recording paper through the torque limiter. The reverse roller 26 is contacted with the feed roller 25 with pressure by the initial pressure caused by a coil spring and the activated pressure caused by torque generated by the torque limiter.

When the reverse roller 26 directly comes into contact with the feed roller 25 (in other words, when there is no paper P in the nip position), or when a sheet of paper P is fed to the nip position, the reverse roller 26 slips exceeding the limit torque and idly rotates following the feed roller 25. However, when not less than 2 sheets of papers P are fed to the nip position, the limit torque overcomes the frictional force between the papers, so that the reverse roller 26 is reversely rotated, and papers P located on the lower side are pushed back so that double feeding of paper can be prevented.

On the other hand, the aforementioned gear G3 meshes with gear G13 through idle gear G12, so that the intermediate roller shaft 33 having a one-way-clutch (not illustrated in the drawing) can be rotated in one direction. The intermediate conveyance roller 34 is integrally provided to the middle portion of the intermediate roller shaft 33, and comes into pressure contact with the idle roller 35 so that the idle roller 35 can be rotated following the intermediate conveyance roller 34.

When the feed roller 27 is rotated by motor M, the aforementioned one-way-clutch K1 is activated so that the feed roller 25 is integrally rotated together with the feed roller shaft 27. When motor M is stopped, the feed roller 25 can be rotated by the external force in the direction described above. However, it can not be rotated in the reverse direction. The pick-up roller shaft having one-way-clutch K2 is operated in the same manner as described above.

The spring clutch 28, which is a one-way-stop-clutch, is mounted on the above-described intermediate shaft 29 in such a manner that the spring clutch 28 is provided between the aforementioned gears G6 and G7. The brake wheel member (for example a ratchet wheel) 28a is integrally provided around the circumference of the clutch 28. The ratchet wheel 28a engages with and released from an engaging claw 30 of solenoid SOL.

The spring clutch 28 provided between the aforementioned ratchet wheel 28a and output gear G7 serves as follows: when the ratchet wheel 28a is engaged with the engaging claw 30 of solenoid SOL, output gear G7 slips with regard to gear G5 which is connected with drive gear G1 of motor M, so that the drive force is not transmitted to gear G8 and a feed roller shaft 27. When the ratchet wheel 28a is released from the engagement by solenoid SOL, the ratchet wheel 28a and output gear G7 are integrally rotated and the drive force of motor M is transmitted to gear G8 so that the feed roller shaft 27 is rotated. When the ratchet wheel 28a is rotated by one revolution, solenoid SOL is activated, and the engaging claw 30 meshes with the tooth portion of the ratchet wheel 28a so that the rotation of the ratchet wheel 28a is stopped.

When the spring clutch 28 and gear G7 are rotated by one revolution, gear G8 which meshes with gear G7 is rotated by a plurality of revolutions. The gear ratio of the gear train is set in such a manner that recording paper P is conveyed by the feed roller 25 so that it can reach the nip position of the intermediate conveyance roller 34.

An arm-shaped cam member 43 is integrally protruded from the surface of the aforementioned gear G7. On the other hand, an oscillating lever 44 is rotatably supported by a bearing 41 protruding a side wall 40 of the paper feeding unit and supported by a support member 42 installed on the fixed wall of the paper feeding unit. One end portion 44a (which is bent so that it can serve as a cam follower) of the aforementioned oscillating member (which will be called an oscillating lever, hereinafter) slidably comes into contact with the aforementioned cam member 43 and follows the rotating motion of the cam member 43 so that the end portion 44a is oscillated. The other bent end portion 44b of the oscillating lever 44, engages with a frame 46 which holds a pick-up roller shaft 45, the pick-up roller 24 and the feed roller 25, and oscillates the pick-up roller 24 around a feed roller shaft 27.

Figure 9:
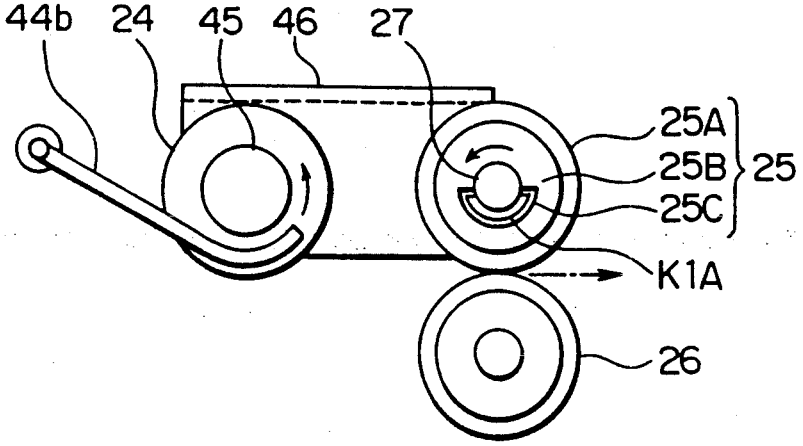
FIG. 9 is a front view of the substantial portion of the paper feeding unit.
Figure 10:
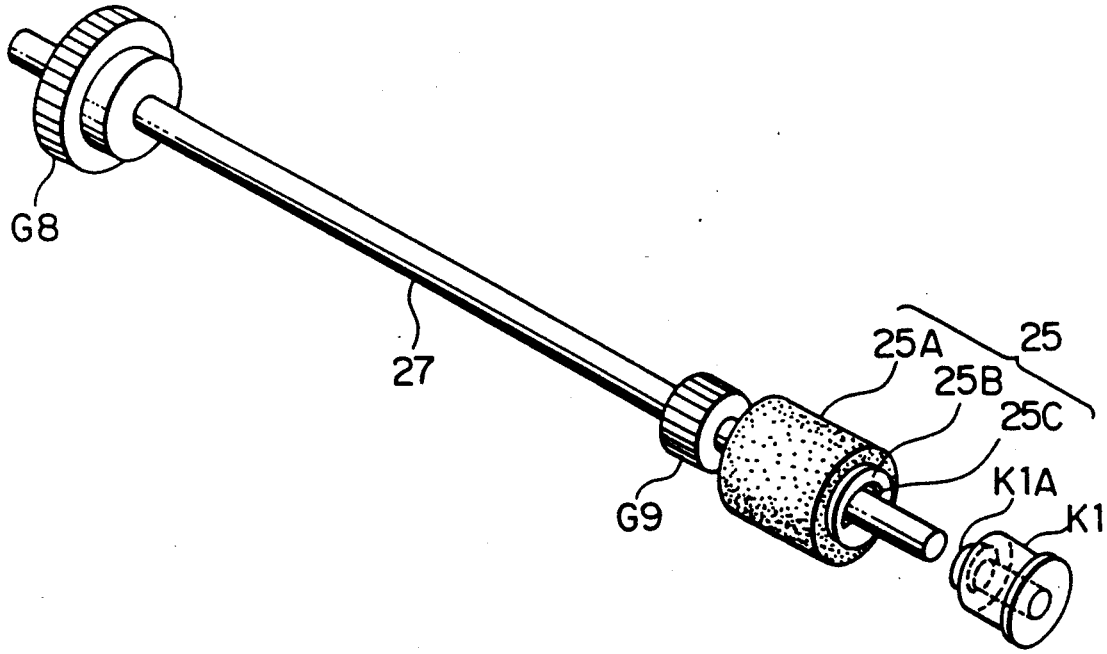
FIG. 10 is an exploded perspective view of a feed roller drive shaft.

FIG. 9 is a front view of the substantial portion of the paper feeding section 20A. FIG. 10 is an exploded perspective view of the feed roller drive shaft In the above-described drawings, the frame 46 supporting the pick-up roller 24 and the feed roller 25, can be oscillated around the feed roller shaft 27. Gear G8 is fixed to one end of the feed roller shaft 27 so that the drive force can be transmitted. To the other end of the feed roller shaft 27 is rotatably provided the feed roller 25 which is composed in such a manner that: the resilient ring 25A made of synthetic rubber is wound around the circumferential surface of the collar member 25B. Further, one way-clutch K1 is rotatably mounted on the position close to the end of the feed roller shaft 27, wherein clutch K1 can be rotated only in one direction.

A semicircular cut-out portion 25C is formed on the outer side surface of the aforementioned collar member 25B, and protruded portion K1A of one-way-clutch K1 engages with the above-described cut-out portion 25C. The angle of circumference of protruded portion K1A is made smaller than the angle of circumference of the aforementioned cut-out portion 25C, and the angle of play is 5°–15°. Accordingly, one-way-clutch K1 can be relatively rotated by the angle of play. To explain more concretely, if one-way-clutch K1 is fixed, the feed roller 25 can be rotated by the aforementioned angle of play.

Specifically, when the aforementioned feed roller 25 is driven, the stopper surface of the aforementioned cut-out portion 25C comes into contact with the stopper surface of the aforementioned protruded portion K1A so that one-way-clutch K1 can be driven.

When the feed roller 25 is stopped, the aforementioned reverse roller 26 is rotated reversely by the reversely driving force of the torque limiter, so that the feed roller 25 which is contacted with the reverse roller 26 with pressure, is reversely rotated by the aforementioned angle of play. After that, the rotation of the reverse roller is stopped.

Next, the operation of the paper feeding unit of the present invention will be explained as follows.

(1) First, the paper feeding cassette 10A is set to the paper feeding stand 21 of the paper feeding section 20A as shown by the upper paper feeding cassette in FIG. 1. When the paper feeding cassette is set to the paper feeding section, the cam surface 13 on the side of the cassette body 11 rotates the oscillation shaft 23 clockwise through the drive force transmitting unit. The push-up lever 22 fixed to the oscillation shaft 23 also rotates clockwise and pushes up the movable bottom plate 12. When the uppermost surface of a stack of recording papers P which have been stacked on the upper surface of the aforementioned movable bottom plate, comes into contact with a detection member (not illustrated in the drawing), the rotation of the oscillation shaft 23 is stopped, and the motion of the push-up lever 22 is stopped under the condition that the push-up lever 22 holds the movable bottom plate 12.

Figure 11A:
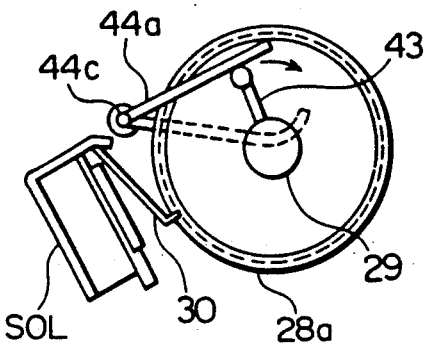
FIG. 11-A and FIG. 11-B are partial front views showing a condition of the above-described paper feeding unit by which a paper is not fed.
Figure 11B:
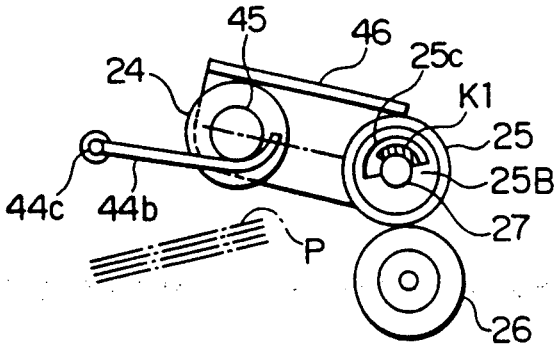

FIG. 11-B is a front view of the paper feeding section which is in the state in which a recording paper is not conveyed. Under the condition that solenoid SOL is not energized, the engaging claw 30 meshes with the ratchet tooth portion of the ratchet wheel 28a so that the ratchet wheel 28a can be stopped. Accordingly, the drive force of motor M is not transmitted to output gear G6. Under the condition described above, the cam portion 43 raises the end portion 44a of the oscillating lever 44, and the other end portion 44b which is combined with the end portion 44a into one body, holds the pickup roller shaft 45 so that the pick-up roller shaft 45 can be positioned at the upper position.

(2) After the paper feeding cassette 10A is set to the paper feeding section 20, a copy button is pressed. Then, the drive shaft of motor M starts to rotate, and gear train G1–G6 of the drive force transmitting system transmits the drive force generated by motor M.

Figure 12A:
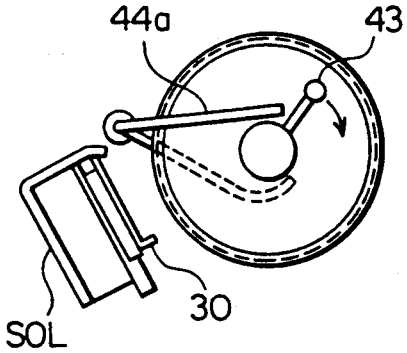
FIG. 12-A, FIG. 12-B, FIG. 13-A, and FIG. 13-B are partial front views showing the paper feeding process conducted by the above-described paper feeding unit.
Figure 12B:
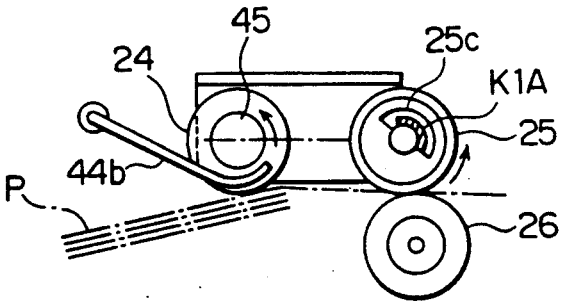
Figure 13A:
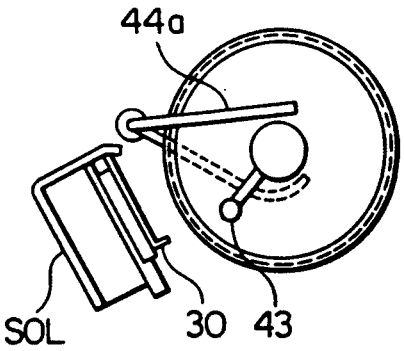
Figure 13B:
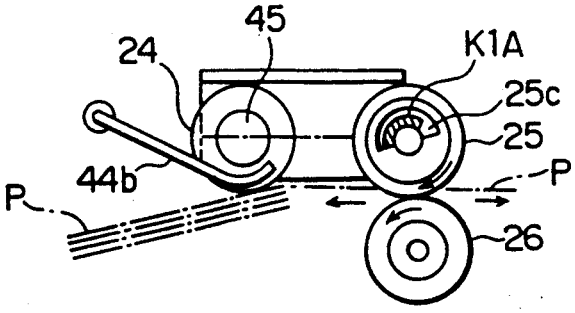

When solenoid SOL is temporarily energized, the engaging claw 30 is disengaged from the ratchet tooth portion of the ratchet wheel 28a so that the engagement is once released. Consequently, the spring clutch 28 transmits the drive force of motor M, and output gear G6 and feed roller shaft 27 are rotated. When output gear G6 is rotated, the cam portion 43 rotates clockwise, and the end portion 44a of the oscillating lever 44 is rotated around the shaft 44c so that the end portion 44a moves from the upper position shown in FIG. 11-A to the lower position shown in FIG. 12-A. FIGS. 12-A and 12-B are front views showing the paper feeding section which is in the state of paper feeding.

(3) When solenoid SOL is turned on, the engaging claw 30 transmitted to gears G7 and G8, and the feed roller shaft 27 is rotated. Then, the feed roller 25 provided on the same shaft starts to rotate, and the pick-up roller 24 simultaneously starts to rotate by the action of gears G9–G11.

(4) The cam member 43 mounted on the intermediate shaft 29, on which the spring clutch 28 and gears G6, G7 are mounted, also starts to rotate since the drive force is transmitted through the aforementioned connection. Accordingly, the end portion 44a of the oscillating lever 44 which slidably comes into contact with the cam member 43, is oscillated around the shaft 44c and goes downward. The other end portion 44b which is combined with the aforementioned end portion 44a into one body, is also oscillated around the shaft 44c and withdraws downward. Consequently, the pick-up roller 24 descends by its own weight around the feed roller shaft 27, and comes into pressure contact with the uppermost surface of a stack of recording papers P which are placed on the movable bottom plate 12A in the paper feeding cassette 10.

(5) When the aforementioned pick-up roller 24 is driven and lowered so that the pick-up roller 24 can contact with the uppermost surface of the recording paper, the upper recording papers P housed in the paper cassette 10A are sent out from the cassette.

(6) The uppermost recording paper P is separated from other papers by the action of the feed roller 25 and reverse roller 26, and conveyed to the following process.

(7) While gears G6, G7, the spring clutch 28 and the cam member 43, which are mounted on the aforementioned intermediate shaft 29, rotates by one revolution, gear G8 which meshes with gear G7 rotates by a predetermined revolution, and the feed roller shaft 27, the feed roller 25 and the pick-up roller 24 also rotates by a predetermined revolution. When the feed roller 25 and the pick-up roller 24 rotate in the manner described above, recording paper P which comes into pressure contact with the circumferential surfaces of those rollers is conveyed, and reaches the nip position between the intermediate conveyance roller 34 and the idle roller 35.

(8) When the rotation of the aforementioned spring clutch 28 almost comes to the end of one revolution, the cam member 43 which is combined with the spring clutch 28 into one unit, raises the end portion 44*a* of the oscillating lever 44.

Accordingly, the other end portion 44*b* raises and oscillates the pick-up roller shaft 45 around the feed roller shaft 27 clockwise. When the pick-up roller shaft 45 is raised, the pick-up roller 24 is separated from the upper surface of the recording paper.

(9) In the above-described paper feeding process, the feed roller 25 is rotated integrally with the feed roller shaft 27, and the pick-up roller 24 is simultaneously rotated since the drive force is transmitted by gear train G9–G11. Specifically, the right end surface of protrusion K1A of one-way-clutch K1 rotated integrally with the feed roller shaft 27, comes into contact with the right end of the cut-out portion 25C of the collar member 25B of the feed roller 25 which is idly engaged with the feed roller shaft 27, so that the feed roller 25 is rotated integrally with one-way-clutch K1.

(10) A sheet of recording paper P which has been fed by the feed roller 25 and the reverse roller 26 of the aforementioned first paper feeding section 20, is conveyed to the register roller 1 which is composed of the drive roller and idle roller of the second paper feeding section, wherein the resister roller 1 is in a stationary condition. Before recording paper P is conveyed to the register roller 1, the leading edge of the recording paper P is detected by the sensor 2, and the drive source of the first paper feeding section 20 is stopped according to the detection signal. When the first paper feeding section 20 has been stopped, recording paper P bumps against the nip portion of the register roller 1. Recording paper P is formed into a loop after the leading edge of the recording paper has been bumped against the register roller 1, and the leading edge of the recording paper enters into the nip portion by the restoring force of the aforementioned loop, and at the same time, the position of the leading edge is rectified so that skew conveyance of recording paper can be prevented.

(11) In the manner described above, recording paper P is pinched and conveyed by the register roller 1. As described above, the first paper feeding section 20 is stopped when recording paper P is conveyed by the register roller 1 so that the feed roller shaft 27 and the pick-up roller shaft 45 are stopped. However, the feed roller 25 which comes into pressure contact with the reverse roller 26, is idly rotated by the force transmitted from the register roller 1 through recording paper P.

When the feed roller 25 is idly rotated, the end surface of the cut-out portion 25C of the collar member 25B composing the feed roller 25, comes into contact with the end surface of protruded portion K1A of one-way-clutch K1, and rotates one-way-clutch K1 in the same direction as illustrated in the drawing. When a sheet of paper exists in the nip portion, the reverse roller 26 rotates normally, and when not less than 2 sheets of papers exist in the nip portion, the reverse roller rotates reversely so that the second and after papers can be pushed back.

(12) FIG. 9 shows the state in which the trailing end of the previously conveyed paper P has passed through the nip portion of the first paper feeding section 20. After recording paper P has passed through the nip portion between the feed roller 25 and the reverse roller 26, the circumferential surface of the reverse roller 26 directly comes into contact with the circumferential surface of the feed roller 25. At this moment, the reverse roller 26 rotates reversely as indicated by an arrow, so that the feed roller 25 also rotates reversely following the rotation of the reverse roller 26. Accordingly, the cut-out portion 25C of the collar member 25B of the feed roller 25 is rotated counterclockwise by the angle of play formed between the cut-out portion 25C and protruded portion K1A of one-way-clutch K1. After that, the cut-out portion 25C is contacted with the end surface (the stopper surface) of protruded portion K1A of one-way-clutch K1 which has been stopped since it can not be reversely rotated. In the manner described above, the rotation of the cut-out portion 25C is stopped.

Since each roller is operated in the manner described above, after the previously conveyed paper P has passed through the nip portion, the successive papers P located close to the nip portion, are pushed back by the action of the feed roller 25 and the reverse roller 26 which are reversely rotated. However, the feed roller 25 is stopped after it has been rotated a little by the angle of play described above, so that paper P is stopped in the position where it is pulled back a little.

While paper P is being pulled back in the manner described above, the aforementioned pick-up roller 24 is oscillated and raised and located in the upper position of paper P, so that paper P can be returned to the paper feeding cassette side without being blocked.

(13) When the aforementioned spring clutch 28 is rotated by one revolution, a voltage is impressed upon solenoid SOL and the engaging claw 30 meshes with the tooth portion of the ratchet wheel 28*a* so that the rotation is stopped and the clutch is disconnected.

(14) When the clutch is disconnected in the manner described above, the drive force transmitting system is disconnected, and gear G7 is stopped. Accordingly, gear G7, the cam portion 43, and the spring clutch 28 are stopped. As a result, the rotation of the feed roller 25 and the pick-up roller 24 is stopped.

As explained above, the pick-up roller 24 is oscillated and raised to the position higher than recording paper P while recording paper P is not conveyed. The pick-up roller 24 is oscillated and lowered only when recording paper P is conveyed. Consequently, even when the paper feeding cassette is pulled out from the apparatus in order to check a paper jam or to supply recording papers, the recording papers housed in the paper feeding cassette and the pick-up roller do not interfere with each other, so that the recording papers are not damaged.

Recording paper P located adjacent to the nip portion is returned to the paper feeding cassette side when the reverse and feed rollers are reversely rotated, so that a paper jam does not occur in the recording papers of the upper layer even when the front loading type of paper feeding cassette is pulled out.

The paper feeding unit of the present invention can provide the following effects.

As explained above, when the paper feeding unit of the present invention is detached from the apparatus, the pick-up roller and the double-feeding-prevention rollers do not interfere with the motion of recording papers, so that a paper jam does not occur and recording papers are not damaged. Consequently, paper feeding can be positively performed and further the paper cassette can be easily replaced.

In the case of the paper feeding unit of the present invention, the rotation and oscillation of the paper feeding roller is conducted by a solenoid, a spring clutch, and an oscillating lever responding to the motion of a cam member. Consequently, a complicated mechanism and synchronization can be eliminated.

In the paper feeding unit of the present invention, after the operation of double feeding, the successive papers are returned by the power of the torque limiter for use in preventing double feeding, so that a specific power source is not necessary and the structure is simple. Further, the durability and stability of the paper feeding unit is excellent, and the size of the unit can be made compact and the cost can be reduced.

What is claimed is:

1. A paper feeding unit for feeding paper in a feeding direction from a stack of papers stored in a paper feeding cassette, the paper feeding unit comprising:

a pick-up roller, having a housing, for pulling out a sheet of paper from the top surface of the stack by coming in contact therewith;

a swing lever, comprising a rod with a bend at each end, for intermittently contacting the housing of the pick-up roller at one bent end by a swing motion thereof for causing the pick-up roller to intermittently come in contact with and retract from the top surface;

cam means for intermittently contacting the other bent end of the swing lever and for swinging the swing lever; and clutch means for intermittently driving the pick-up roller to rotate a predetermined rotation angle by each driver.

2. The paper feeding unit of claim 1, further comprising:

means for supplying mechanical power;

first transmitting means, including an intermediate axis, for transmitting the power to the cam means; and second transmitting means for transmitting power from the first transmitting means to the pick up roller;

the cam means and the clutch means being concentric to the intermediate axis of the first transmitting means.

3. The paper feeding unit of claim 1, further comprising:

a feed roller located downstream the pick-up roller in the feeding direction for feeding the pulled out paper, the feed roller having a nip point;

a gear train operatively between the clutch means and the pick-up roller; and a reduction gear between the clutch means and the pick-up roller for setting the gear ratio of the gear train between the clutch means and the pick up roller for pulling the sheet of paper out by the pick-up roller until the leading edge of the pulled out paper reaches the nip point of the feed roller.

4. A paper feeding unit for feeding paper in a feeding direction from a stack of paper sheets stored in a paper feeding cassette, the paper feeding unit comprising:

a pick-up roller adapted to be contacted to and retracted from the top surface of a paper sheet for pulling out a top paper sheet by coming in contact with the top surface of the top paper sheet;

shifting means for intermittently making the pick-up roller come in contact with and retract from the top surface;

a feed roller located downstream of the pick-up roller in the feeding direction for feeding the pulled out paper;

a reverse roller contacting the feed roller so as to nip the pulled out paper between the feed roller and the reverse roller;

feed roller driving means for intermittently rotating the feed roller in a rotating direction so as to feed the pulled out paper in the feeding direction; and reverse roller driving means for applying a reverse torque to the reverse roller, the reverse torque being a limited amount of torque directing in a reverse rotating direction to counteract the feeding of the pulled out paper by the feed roller, wherein the feed roller driving means comprises;

a one-way clutch for restricting the rotation of the feed roller, and means provided at a transmitting portion between the feed roller and the one-way clutch for giving a predetermined idling angle of rotation to the feed roller, wherein the feed roller is rotated backward through the idling angle driven by the reverse roller after a sheet of paper having been fed out and the pick-up roller having been retracted from the top surface, thereby feeding back successive sheets of paper toward the stack.

5. The paper feeding unit of claim 4, wherein the reverse roller driving means includes a torque limiter for limiting the amount of the reverse torque applied to the reverse roller.

6. A paper feeding unit for feeding paper in a feeding direction from a stack of papers stored in a paper feeding cassette, the paper feeding unit comprising:

a pick-up roller, having a housing, for pulling out a sheet of paper from a top surface of the stack by coming in contact therewith;

a swing lever, comprising a rod with a bend at each end, for intermittently contacting the housing of the pick-up roller at one bent end by a swing motion thereof for causing the pick-up roller to intermittently come in contact with and retract from the top surface;

cam means for intermittently contacting another bent end of the swing lever and for swinging the swing lever;

clutch means for intermittently driving the pick-up roller to rotate a predetermined rotation angle by each drive;

a feed roller located downstream of the pick-up roller in the feeding direction for feeding the pulled out paper;

a reverse roller for contacting the feed roller once the sheet of paper has passed the feed roller, and for rotating in a first rotating direction, coinciding with the rotating direction of the feed roller;

a one-way clutch for restricting the rotation of the feed roller to the first rotating direction; and means between the feed roller and the one-way clutch for interfacing the feed roller to the one-way clutch and for allowing the feed roller to rotate in a second rotating direction opposite to the first rotating direction, for a predetermined angle of rotation, the feed roller being rotated in the second rotating direction through the predetermined angle of rotation driven by the reverse roller after a sheet of paper has been fed out and the pick-up roller has been retracted from the top surface, thereby feeding back successive sheets of paper towards the stack.

* * * * *